US011019911B2

(12) United States Patent
Petersen

(10) Patent No.: US 11,019,911 B2
(45) Date of Patent: Jun. 1, 2021

(54) USER WORN HYDRATION DEVICE

(71) Applicant: Daniel Petersen, Blanco, TX (US)

(72) Inventor: Daniel Petersen, Blanco, TX (US)

( * ) Notice: Subject to any disclaimer, the term of this patent is extended or adjusted under 35 U.S.C. 154(b) by 0 days.

(21) Appl. No.: 16/660,945

(22) Filed: Oct. 23, 2019

(65) Prior Publication Data

US 2021/0120939 A1 Apr. 29, 2021

(51) Int. Cl.
*A45F 3/20* (2006.01)
*A45F 3/00* (2006.01)
*A45F 3/16* (2006.01)

(52) U.S. Cl.
CPC ..... *A45F 3/20* (2013.01); *A45F 3/005* (2013.01); *A45F 2003/166* (2013.01)

(58) Field of Classification Search
CPC ..... A45F 2003/166; A45F 3/20; A45F 3/005; A61M 5/152
See application file for complete search history.

(56) References Cited

U.S. PATENT DOCUMENTS 4,029,243 A * 6/1977 Zerobnick ..... A45F 3/00 224/681
4,090,650 A 5/1978 Gotta
4,176,772 A * 12/1979 Danon ..... A45F 3/20 224/148.5
5,016,797 A * 5/1991 Rowledge ..... A45F 5/00 224/257
5,104,016 A 4/1992 Runkel
5,431,308 A 7/1995 Tchen
5,571,260 A 11/1996 Krug
5,975,387 A * 11/1999 Gleason ..... A45F 3/047 224/148.2
6,126,041 A * 10/2000 DiTomasso ..... A45F 3/20 222/175
6,598,770 B2 * 7/2003 Bolts ..... A45F 3/00 224/148.2
6,666,360 B1 12/2003 Swank
7,201,299 B2 * 4/2007 Forsman ..... A45F 3/14 224/148.2
D543,025 S * 5/2007 Cicione ..... D3/224
8,453,893 B2 6/2013 Shitaye
9,642,444 B2 * 5/2017 Krol ..... A45F 3/14
D805,766 S 12/2017 Bogue
10,542,739 B1 * 1/2020 Silverman ..... A47C 1/146
2006/0231561 A1 * 10/2006 Choi ..... A45F 3/20 220/714
2007/0034634 A1 * 2/2007 Brown ..... A45F 3/16 220/703

* cited by examiner

*Primary Examiner* — Scott T McNurlen

(57) ABSTRACT

A user worn hydration device for wearing around a waist of a user includes a bladder, which is positioned in a sleeve that is configured to be positioned around a waist of a user so that the sleeve is coupled to the user. The bladder is configured to position a fluid. A tube, which is resiliently flexible, is coupled to a bottom of the bladder and extends through a hole that is positioned in the sleeve. A mouthpiece that is coupled to the tube distal from the bladder in fluidic communication with the bladder through the tube. A valve positioned in the mouthpiece so that the mouthpiece is configured to be clamped between teeth of the user to open the valve, positioning the user to draw the fluid from the bladder through the tube.

17 Claims, 5 Drawing Sheets

FIG. 5
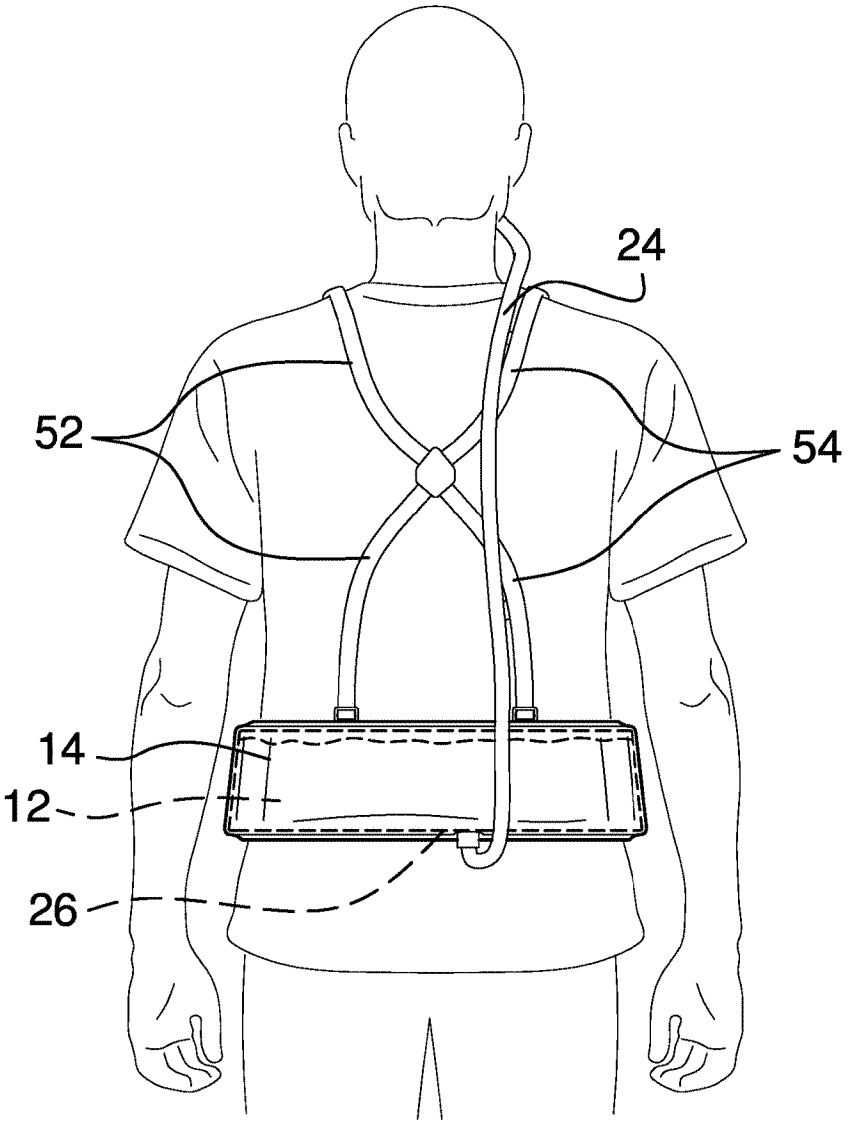
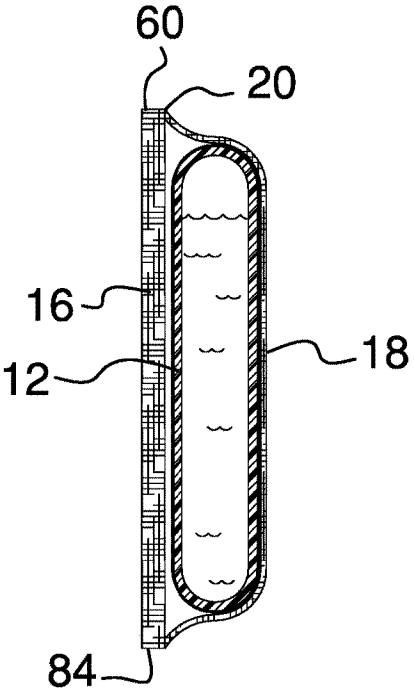
FIG. 4

USER WORN HYDRATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to hydration devices and more particularly pertains to a new hydration device for wearing around a waist of a user.

(2) Description of Related Art Including Information Disclosed Under 37 CFR 1.97 and 1.98

The prior art relates to hydration devices.

BRIEF SUMMARY OF THE INVENTION

An embodiment of the disclosure meets the needs presented above by generally comprising a bladder, which is positioned in a sleeve that is configured to be positioned around a waist of a user so that the sleeve is coupled to the user. The bladder is configured to position a fluid. A tube, which is resiliently flexible, is coupled to a bottom of the bladder and extends through a hole that is positioned in the sleeve. A mouthpiece that is coupled to the tube distal from the bladder in fluidic communication with the bladder through the tube. A valve positioned in the mouthpiece so that the mouthpiece is configured to be clamped between teeth of the user to open the valve, positioning the user to draw the fluid from the bladder through the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 4 is a cross-sectional view of an embodiment of the disclosure.

FIG. 5 is an in-use view of an embodiment of the disclosure.

DETAILED DESCRIPTION OF THE INVENTION

Figure 1:
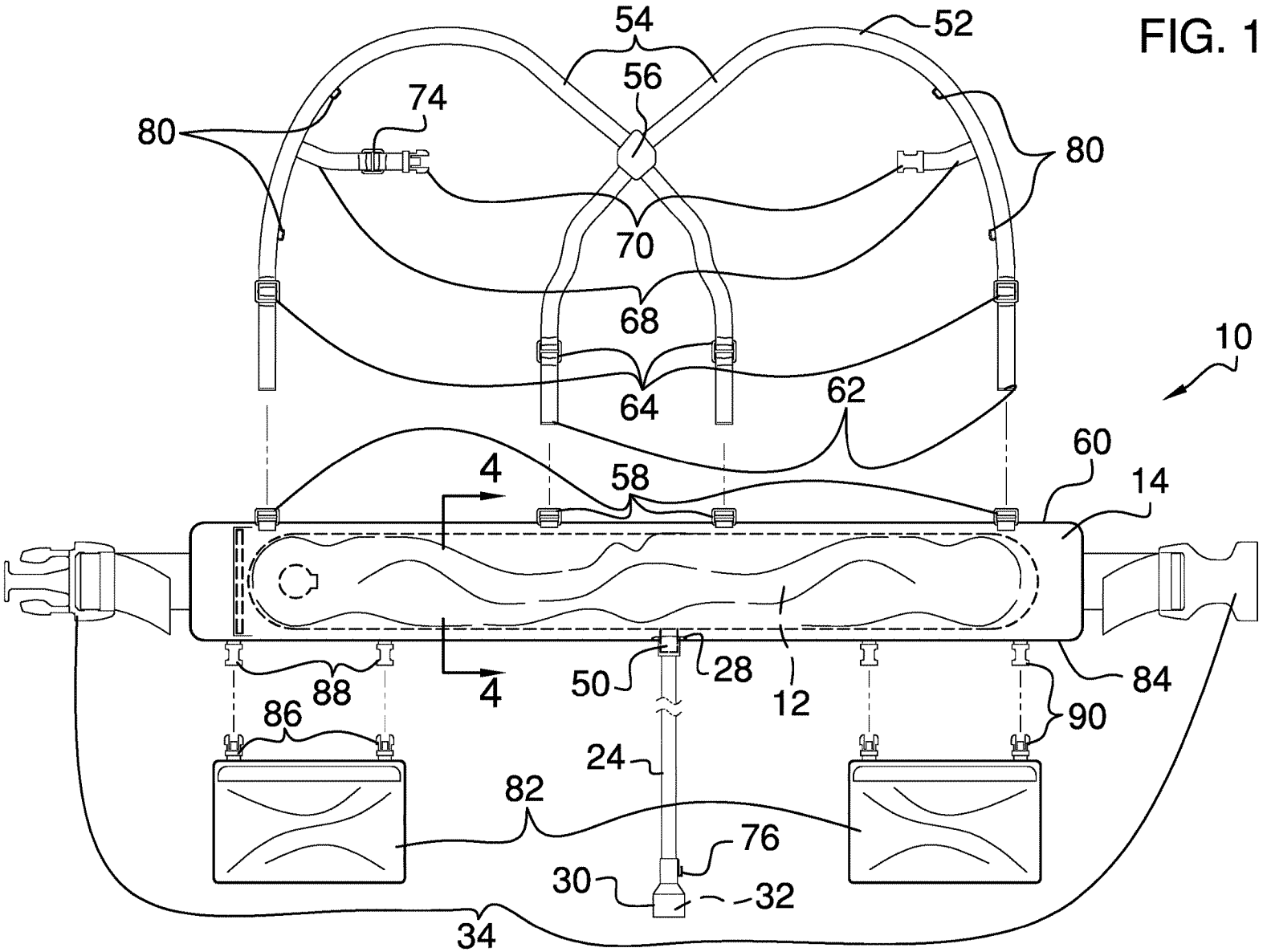
FIG. 1 is a front view of a user worn hydration device according to an embodiment of the disclosure.

With reference now to the drawings, and in particular to FIGS. 1 through 6 thereof, a new hydration device embodying the principles and concepts of an embodiment of the disclosure and generally designated by the reference numeral 10 will be described.

As best illustrated in FIGS. 1 through 6, the user worn hydration device 10 generally comprises a bladder 12, which is positioned in a sleeve 14 that is configured to be positioned around a waist of a user so that the sleeve 14 is coupled to the user. The sleeve 14 may be resiliently stretchable so that the sleeve 14 is configured to apply pressure to contents of the sleeve 14 and to adjust to a circumference of a waist of the user.

The sleeve 14 may comprise an inner panel 16 and an outer panel 18, as shown in FIG. 4. The inner panel 16 is substantially inelastic and configured to position around the waist of the user. The outer panel 18 is resiliently stretchable and is coupled to a perimeter 20 of the inner panel 16. The outer panel 18 is configured to apply pressure to the contents of the sleeve 14.

The bladder 12 extends from proximate to opposing endpoints 22 of the sleeve 14 and is configured to position a fluid, such as water and a sport drink. A tube 24, which is resiliently flexible, is coupled to a bottom 26 of the bladder 12 and extends through a hole 28 that is positioned in the sleeve 14. A mouthpiece 30 that is coupled to the tube 24 distal from the bladder 12 is in fluidic communication with the bladder 12 through the tube 24. A valve 32 is positioned in the mouthpiece 30 so that the mouthpiece 30 is configured to be clamped between teeth of the user to open the valve 32, positioning the user to draw the fluid from the bladder 12 through the tube 24.

A pair of belt fasteners 34 is coupled singly to the opposing endpoints 22 of the sleeve 14. The belt fasteners 34 are selectively mutually couplable to selectively secure the sleeve 14 around the waist of the user. The pair of belt fasteners 34 may comprise a belt side release buckle 36, or other fastening means, such as, but not limited to, hook and loop fasteners, tongue buckles, and the like.

A pair of belt straps 38 is coupled singly to and extends from the opposing endpoints 22 of the sleeve 14. The pair of belt fasteners 34 is slidably coupled singly to the pair of belt straps 38 so that the pair of belt fasteners 34 is selectively positionable relative to the sleeve 14. Thus, the sleeve 14 and the pair of belt straps 38 are selectively sizable to the circumference of the waist of the user.

Figure 3:
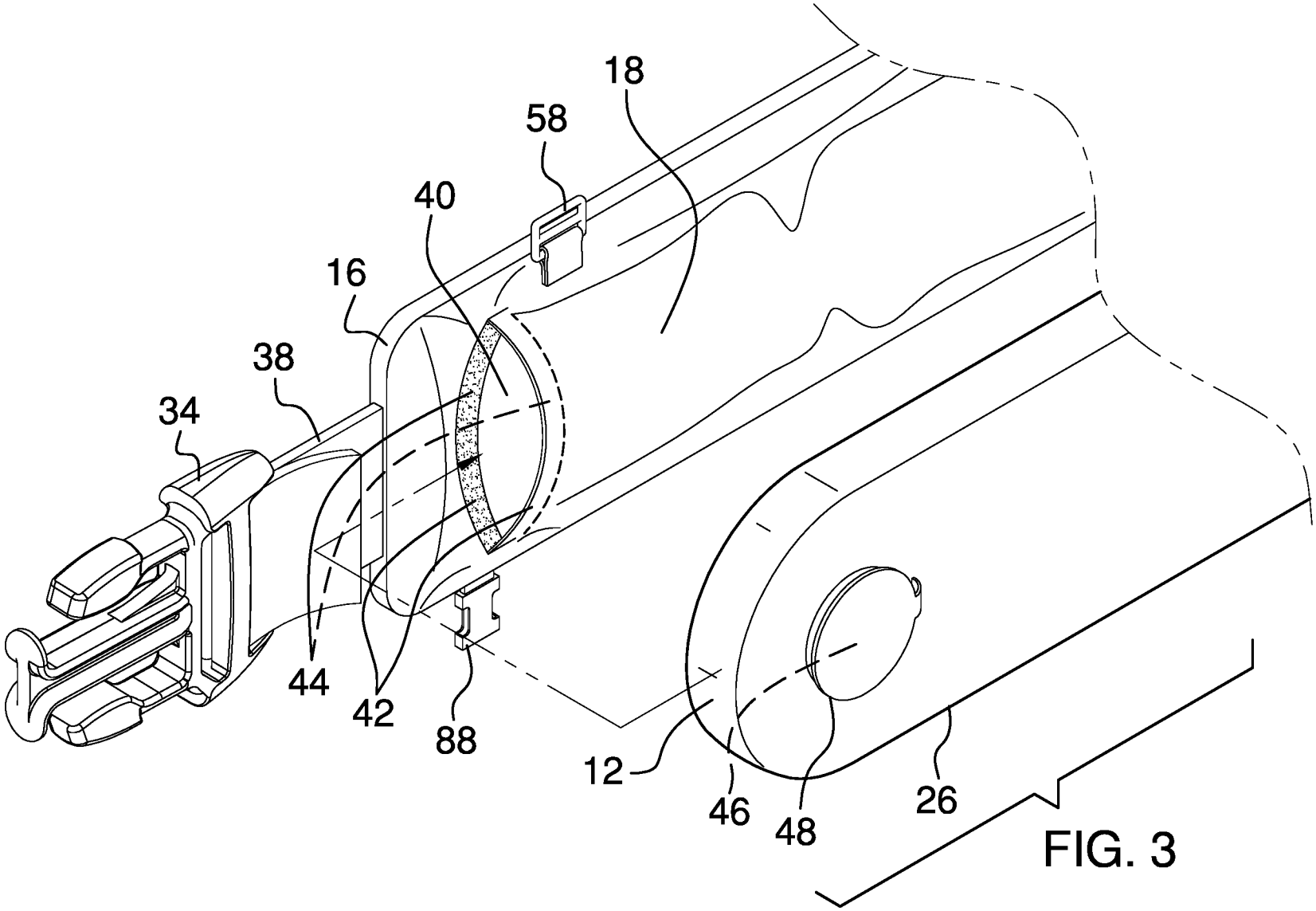
FIG. 3 is a detail view of an embodiment of the disclosure.
Figure 6:
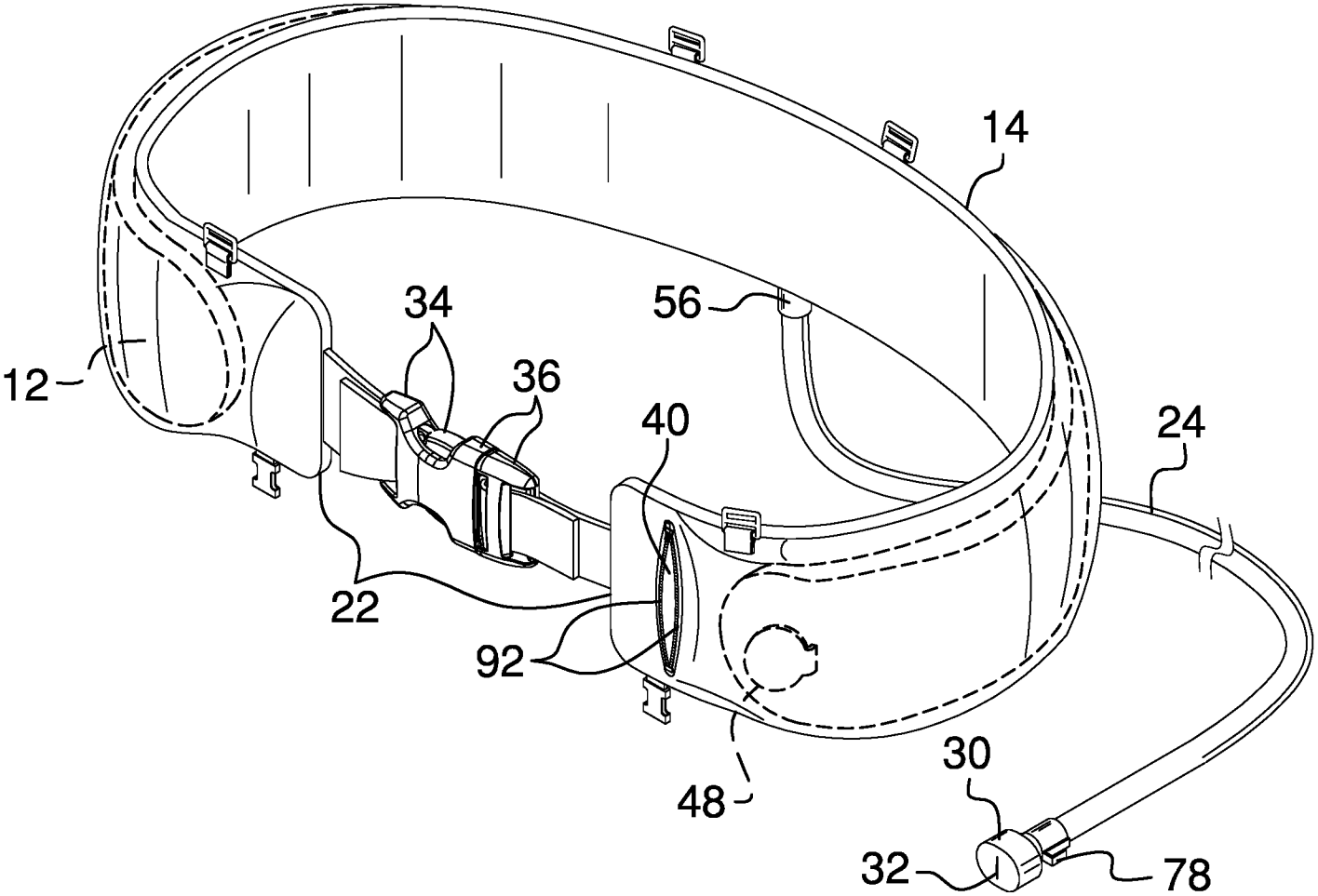
FIG. 6 is an isometric perspective view of an embodiment of the disclosure.

A slit 40 is positioned in the sleeve 14 proximate to a respective opposing endpoint 22 of the sleeve 14 so that the bladder 12 is selectively positionable in the sleeve 14. A closure 42 is coupled to the sleeve 14 proximate to the slit 40 so that the closure 42 is positioned to selectively close the slit 40 to retain the bladder 12 in the sleeve 14. The closure 42 may comprise at least one of a hook and loop fastener 44, as shown in FIG. 3, and a zipper 92, as shown in FIG. 6. The closure 42 also may comprise other closing means, such as, but not limited to, snap closures, button closures, and the like.

A port 46 that is positioned in the bladder 12 is configured to allow for filling and emptying of the bladder 12. A cap 48 that is hingedly coupled to the bladder 12 proximate to the port 46 is positioned to selectively seal the port 46.

A pipe 50 is coupled to the bottom 26 of the bladder 12 and extends through the hole 28. The tube 24 is removably couplable to the pipe 50. The tube 24 is selectively decouplable from the pipe 50 to facilitate placement of the bladder 12 in, and extraction of the bladder 12 from, the sleeve 14.

A harness 52 that is selectively couplable to the sleeve 14 is positionable over shoulders of the user. The harness 52 is configured to partially support a mass of the fluid that is positioned in the bladder 12 upon the shoulders of the user. The harness 52 comprises a pair of suspender straps 54 and a connector 56. The connector 56 is coupled to each of the suspender straps 54 so that the pair of suspender straps 54 is X-shaped. The connector 56 may be slidably coupled to each of the suspender straps 54 so that the connector 56 is selectively positionable on the pair of suspender straps 54.

Figure 2:
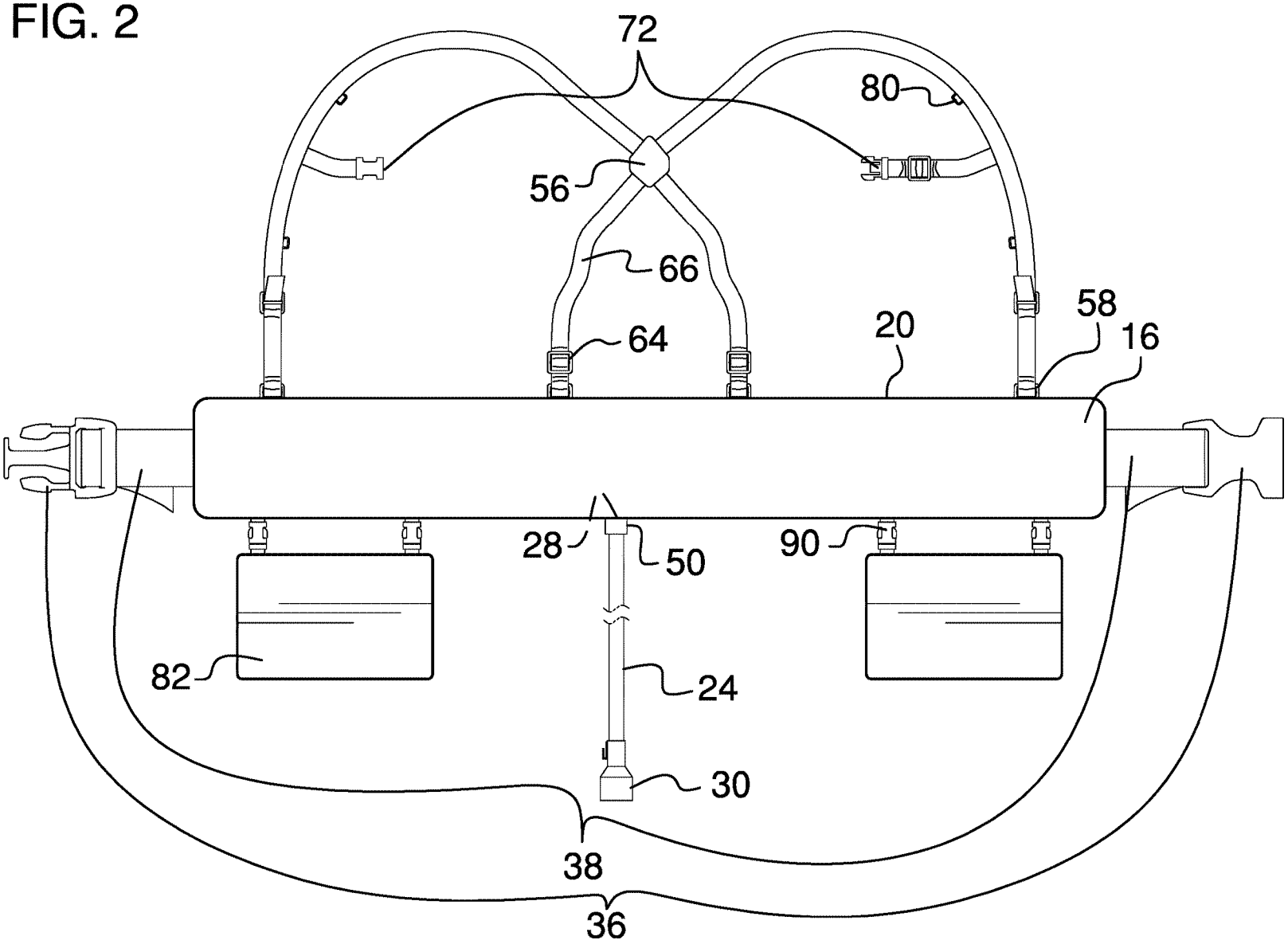
FIG. 2 is a back view of an embodiment of the disclosure.

A set of four suspender fasteners 58 is coupled to an upper limit 60 of the sleeve 14 so that the suspender fasteners 58 are positioned two apiece on a front and a back of the user when the sleeve 14 is coupled around the waist of the user. Each suspender fastener 58 is positioned to selectively couple to a respective suspender strap 54, proximate to a respective opposing terminus 62 of the respective suspender strap 54, to removably couple the harness 52 to the sleeve 14. The suspender fasteners 58 are slip lock type, as shown in FIG. 2.

A set of four strap clips 64 is coupled two apiece to each of the suspender straps 54. The strap clips 64 are slip lock type so that each strap clip 64 is positioned for length adjustment of an associated segment 66 of a respective suspender strap 54.

A pair of chest straps 68 is coupled singly to and extends from the pair of suspender straps 54 so that the pair of chest straps 68 is positionable over a chest of the user. A pair of chest fasteners 70 is coupled singly to the chest straps 68 distal from the suspender straps 54. The chest fasteners 70 are selectively mutually couplable to secure the pair of chest straps 68 between the pair of suspender straps 54, with the pair of chest straps 68 extending substantially horizontally between the pair of suspender straps 54. The pair of chest fasteners 70 may comprise a suspender side release buckle 72, or other fastening means, such as, but not limited to, hook and loop fasteners, button fasteners, and the like.

Each of a set of suspender clips 74 is coupled to a respective chest strap 68. The suspender clip 74, which is slip lock type, is configured for length adjustment of the respective chest strap 68. The set of suspender clips 74 may comprise one suspender clip 74, as shown in FIG. 1.

A hose fastener 76 that is coupled to the tube 24 proximate to the mouthpiece 30 is configured to selectively couple the tube 24 to the user. The hose fastener 76 may comprise a hose clip 78, as shown in FIG. 2, or other fastening means, such as, but not limited to, hook and loop fasteners, pressure sensitive adhesives, magnets, and the like.

Each of a set of rings 80 that is coupled to the harness 52 is configured for clipping to a respective article of the user to couple the article to the harness 52. The set of rings 80 may comprise four rings 80, as shown in FIG. 2.

Each of a set of pouches 82 that is selectively couplable to a lower limit 84 of the sleeve 14 is configured to position a respective item of the user. The set of pouches 82 may comprise two pouches 82, as shown in FIG. 2.

A set of first bag fasteners 86 is coupled two apiece to each pouch 82. A set of second bag fasteners 88 is coupled to the lower limit 84 of the sleeve 14. The second bag fasteners 88 are complementary to the first bag fasteners 86 so that each second bag fastener 88 is positioned to selectively couple to a respective first bag fastener 86 to removably couple an associated pouch 82 to the sleeve 14. The second bag fastener 88 and the respective first bag fastener 86 may comprise a bag side release buckle 90, or other fastening means, such as, but not limited to, hook and loop fasteners, button fasteners, snap fasteners, and the like.

In use, the bladder 12 is filled via the port 46 with a fluid of the user's choice, such as water and a sport drink, and the cap 48 is used to seal the port 46. The bladder 12 is inserted through the slit 40 into the sleeve 14 and the pipe 50 through the hole 28, positioning the pipe 50 to couple to the tube 24. The sleeve 14 then is positioned around the waist of the user and fastened in place using the belt side release buckle 36. The tube 24 is extended to proximate to the mouth of the user and fastened in place using the hose fastener 76 so that the mouthpiece 30 is conveniently positioned for use. When the user requires hydration, the mouthpiece 30 is positioned between the teeth and clamped to open the valve 32, positioning the user to draw the fluid from the bladder 12 through the tube 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A user worn hydration device comprising:

a sleeve configured for positioning around a waist of a user such that the sleeve is coupled to the user, the sleeve comprising an inner panel and an outer panel, the inner panel being substantially inelastic and configured for positioning around the waist of the user, the outer panel being coupled to a perimeter of the inner panel, the outer panel being resiliently stretchable wherein the outer panel is configured for applying pressure to the contents of the sleeve;

a bladder positioned in the sleeve wherein the bladder is configured for positioning a fluid;

a tube coupled to a bottom of the bladder and extending through a hole positioned in the sleeve, the tube being resiliently flexible;

a mouthpiece coupled to the tube distal from the bladder such that the mouthpiece is in fluidic communication with the bladder through the tube; and a valve positioned in the mouthpiece wherein the mouthpiece is configured for clamping between teeth of the user for opening the valve positioning the user for drawing the fluid from the bladder through the tube;

a set of pouches selectively couplable to a lower limit of the sleeve wherein each pouch is configured for positioning a respective item of the user, the set of pouches comprising two pouches;

a set of first bag fasteners coupled two apiece to each pouch; and a set of second bag fasteners coupled to the lower limit of the sleeve, the second bag fasteners being complementary to the first bag fasteners such that each second bag fastener is positioned for selectively coupling to a respective first bag fastener wherein each pouch hangs from the sleeve when coupled to the sleeve, the second bag fastener and the respective first bag fastener comprising a bag side release buckle.

2. The device of claim 1, further including the sleeve being resiliently stretchable wherein the sleeve is configured for applying pressure to contents of the sleeve and for adjusting to a circumference of a waist of the user.

3. The device of claim 1, further including a pair of belt fasteners coupled singly to opposing endpoints of the sleeve, the belt fasteners being selectively mutually couplable for selectively securing the sleeve around the waist of the user, the pair of belt fasteners comprising a belt side release buckle.

4. The device of claim 3, further including a pair of belt straps coupled singly to and extending from the opposing endpoints of the sleeve, the pair of belt fasteners being slidably coupled singly to the pair of belt straps such that the pair of belt fasteners is selectively positionable relative to the sleeve such that the sleeve and the pair of belt straps are selectively sizable to a circumference of the waist of the user.

5. The device of claim 1, further including the bladder extending from proximate to opposing endpoints of the sleeve.

6. The device of claim 1, further comprising:

a slit positioned in the sleeve such that the bladder is selectively positionable in the sleeve, the slit being positioned proximate to a respective opposing endpoint of the sleeve; and a closure coupled to the sleeve proximate to the slit such that the closure is positioned for selectively closing the slit for retaining the bladder in the sleeve, the closure comprising at least one of a hook and loop fastener and a zipper.

7. The device of claim 6, further comprising:

a port positioned in the bladder wherein the port is configured for filling and emptying the bladder; and a cap hingedly coupled to the bladder proximate to the port such that the cap is positioned for selectively sealing the port.

8. The device of claim 6, further including a pipe coupled to the bottom of the bladder and extending through the hole, the tube being removably couplable to the pipe such that the tube is selectively decouplable from the pipe for facilitating placement of the bladder in, and extraction of the bladder from, the sleeve.

9. The device of claim 1, further including a harness selectively couplable to the sleeve such that the harness is positionable over shoulders of the user wherein the harness is configured for partially supporting a mass of the fluid positioned in the bladder upon the shoulders of the user.

10. The device of claim 9, further including a set of rings coupled to the harness wherein each ring is configured for clipping to a respective article of the user for coupling the article to the harness, the set of rings comprising four rings.

11. The device of claim 9, further including the harness comprising a pair of suspender straps and a connector, the connector being coupled to each of the suspender straps such that the pair of suspender straps is X-shaped, the connector being slidably coupled to each of the suspender straps such that the connector is selectively positionable on the pair of suspender straps.

12. The device of claim 11, further including a set of four suspender fasteners coupled to an upper limit of the sleeve such that the suspender fasteners are positioned two apiece on a front and a back of the user when the sleeve is coupled around the waist of the user such that each suspender fastener is positioned for selectively coupling to a respective suspender strap proximate to a respective opposing terminus of the respective suspender strap for removably coupling the harness to the sleeve, the suspender fasteners being slip lock type.

13. The device of claim 12, further including a set of four strap clips coupled two apiece to each of the suspender straps, the strap clips being slip lock type such that each strap clip is positioned for length adjustment of an associated segment of a respective suspender strap.

14. The device of claim 11, further comprising:

a pair of chest straps coupled singly to and extending from the pair of suspender straps such that the pair of chest straps is positionable over a chest of the user; and a pair of chest fasteners coupled singly to the chest straps distal from the suspender straps, the chest fasteners being selectively mutually couplable for securing the pair of chest straps between the pair of suspender straps with the pair of chest straps extending substantially horizontally between the pair of suspender straps, the pair of chest fasteners comprising a suspender side release buckle.

15. The device of claim 14, further including a set of suspender clips, each suspender clip being coupled to a respective chest strap, the suspender clip being slip lock type wherein the suspender clip is configured for length adjustment of the respective chest strap, the set of suspender clips comprising one suspender clip.

16. The device of claim 1, further including a hose fastener coupled to the tube proximate to the mouthpiece wherein the hose fastener is configured for selectively coupling the tube to the user, the hose fastener comprising a hose clip.

17. A user worn hydration device comprising:

a sleeve configured for positioning around a waist of a user such that the sleeve is coupled to the user, the sleeve being resiliently stretchable wherein the sleeve is configured for applying pressure to contents of the sleeve and for adjusting to a circumference of a waist of the user, the sleeve comprising an inner panel and an outer panel, the inner panel being substantially inelastic and configured for positioning around the waist of the user, the outer panel being coupled to a perimeter of the inner panel, the outer panel being resiliently stretchable wherein the outer panel is configured for applying pressure to the contents of the sleeve;

a pair of belt fasteners coupled singly to opposing endpoints of the sleeve, the belt fasteners being selectively mutually couplable for selectively securing the sleeve around the waist of the user, the pair of belt fasteners comprising a belt side release buckle;

a pair of belt straps coupled singly to and extending from the opposing endpoints of the sleeve, the pair of belt fasteners being slidably coupled singly to the pair of belt straps such that the pair of belt fasteners is selectively positionable relative to the sleeve such that the sleeve and the pair of belt straps are selectively sizable to the circumference of the waist of the user;

a bladder positioned in the sleeve wherein the bladder is configured for positioning a fluid, the bladder extending from proximate to opposing endpoints of the sleeve;

a slit positioned in the sleeve such that the bladder is selectively positionable in the sleeve, the slit being positioned proximate to a respective opposing endpoint of the sleeve;

a closure coupled to the sleeve proximate to the slit such that the closure is positioned for selectively closing the slit for retaining the bladder in the sleeve, the closure comprising at least one of a hook and loop fastener and a zipper;

a port positioned in the bladder wherein the port is configured for filling and emptying the bladder;

a cap hingedly coupled to the bladder proximate to the port such that the cap is positioned for selectively sealing the port;

a tube coupled to a bottom of the bladder and extending through a hole positioned in the sleeve, the tube being resiliently flexible;

a pipe coupled to the bottom of the bladder and extending through the hole, the tube being removably couplable to the pipe such that the tube is selectively decouplable from the pipe for facilitating placement of the bladder in, and extraction of the bladder from, the sleeve;

a mouthpiece coupled to the tube distal from the bladder such that the mouthpiece is in fluidic communication with the bladder through the tube;

a valve positioned in the mouthpiece wherein the mouthpiece is configured for clamping between teeth of the user for opening the valve positioning the user for drawing the fluid from the bladder through the tube;

a harness selectively couplable to the sleeve such that the harness is positionable over shoulders of the user wherein the harness is configured for partially supporting a mass of the fluid positioned in the bladder upon the shoulders of the user, the harness comprising a pair of suspender straps and a connector, the connector being coupled to each of the suspender straps such that the pair of suspender straps is X-shaped, the connector being slidably coupled to each of the suspender straps such that the connector is selectively positionable on the pair of suspender straps;

a set of four suspender fasteners coupled to an upper limit of the sleeve such that the suspender fasteners are positioned two apiece on a front and a back of the user when the sleeve is coupled around the waist of the user such that each suspender fastener is positioned for selectively coupling to a respective suspender strap proximate to a respective opposing terminus of the respective suspender strap for removably coupling the harness to the sleeve, the suspender fasteners being slip lock type;

a set of four strap clips coupled two apiece to each of the suspender straps, the strap clips being slip lock type such that each strap clip is positioned for length adjustment of an associated segment of a respective suspender strap;

a pair of chest straps coupled singly to and extending from the pair of suspender straps such that the pair of chest straps is positionable over a chest of the user;

a pair of chest fasteners coupled singly to the chest straps distal from the suspender straps, the chest fasteners being selectively mutually couplable for securing the pair of chest straps between the pair of suspender straps with the pair of chest straps extending substantially horizontally between the pair of suspender straps, the pair of chest fasteners comprising a suspender side release buckle;

a set of suspender clips, each suspender clip being coupled to a respective chest strap, the suspender clip being slip lock type wherein the suspender clip is configured for length adjustment of the respective chest strap, the set of suspender clips comprising one suspender clip;

a hose fastener coupled to the tube proximate to the mouthpiece wherein the hose fastener is configured for selectively coupling the tube to the user, the hose fastener comprising a hose clip;

a set of rings coupled to the harness wherein each ring is configured for clipping to a respective article of the user for coupling the article to the harness, the set of rings comprising four rings;

a set of pouches selectively couplable to a lower limit of the sleeve wherein each pouch is configured for positioning a respective item of the user, the set of pouches comprising two pouches;

a set of first bag fasteners coupled two apiece to each pouch; and a set of second bag fasteners coupled to the lower limit of the sleeve, the second bag fasteners being complementary to the first bag fasteners such that each second bag fastener is positioned for selectively coupling to a respective first bag fastener for removably coupling an associated pouch to the sleeve, the second bag fastener and the respective first bag fastener comprising a bag side release buckle.

* * * * *